US007789251B1

(12) United States Patent
Clark

(10) Patent No.: US 7,789,251 B1
(45) Date of Patent: Sep. 7, 2010

(54) A-FRAME SHELVING

(76) Inventor: John R Clark, 9739 Tom St., Hudson, FL (US) 34669

( * ) Notice: Subject to any disclaimer, the term of this patent is extended or adjusted under 35 U.S.C. 154(b) by 254 days.

(21) Appl. No.: 12/077,363

(22) Filed: Mar. 19, 2008

(51) Int. Cl.
*A47B 43/00* (2006.01)

(52) U.S. Cl. ..... 211/198; 211/134; 211/186; 248/150; 248/166; 108/180; 108/193

(58) Field of Classification Search ..... 211/198, 211/134, 206, 189, 186, 187; 108/180, 193, 108/107, 110, 147.16; 248/150, 166
See application file for complete search history.

(56) References Cited

U.S. PATENT DOCUMENTS

| | | | | | |
|---|---|---|---|---|---|
| 53,705 | A * | 4/1866 | Trask | 211/198 |
| 391,191 | A * | 10/1888 | Ritterhouse | 211/198 |
| 956,399 | A * | 4/1910 | Morse | 211/85 |
| 1,599,083 | A * | 9/1926 | Gagne | 211/198 |
| 2,002,128 | A * | 5/1935 | Reidenbaugh | 211/1 |
| 2,114,357 | A * | 4/1938 | Schott | 211/85 |
| 2,122,770 | A * | 7/1938 | Colin | 211/13.1 |
| 2,400,659 | A * | 5/1946 | St-Mars | 182/119 |
| 3,170,418 | A * | 2/1965 | Gruenstein | 108/101 |
| 3,715,097 | A * | 2/1973 | Kalajian | 248/449 |
| D259,007 | S * | 4/1981 | Schuckenbrock | D6/474 |
| D273,067 | S * | 3/1984 | Evans | D6/462 |
| D284,122 | S * | 6/1986 | Kizen | D30/143 |
| 4,739,888 | A * | 4/1988 | Steiner | 211/198 |
| D334,309 | S * | 3/1993 | Stricker | D6/474 |
| 5,272,317 | A * | 12/1993 | Ryu | 219/403 |
| 5,287,946 | A * | 2/1994 | Mayo | 182/165 |
| 5,921,347 | A * | 7/1999 | Rodriguez et al. | 182/186.2 |
| D417,536 | S * | 12/1999 | Sum | D32/58 |
| 6,267,345 | B1 * | 7/2001 | Turner | 248/447 |
| 6,470,632 | B1 * | 10/2002 | Smith | 52/92.2 |
| D467,096 | S * | 12/2002 | DiCostanzo | D6/446 |
| 6,883,267 | B1 * | 4/2005 | Pruitt | 43/54.1 |
| 2003/0164343 | A1 * | 9/2003 | Kaufmann | 211/13.1 |
| 2008/0132132 | A1 * | 6/2008 | Qiu et al. | 442/151 |

* cited by examiner

*Primary Examiner*—Darnell M Jayne
*Assistant Examiner*—Devin Barnett
(74) *Attorney, Agent, or Firm*—Ronald E. Smith; Smith & Hopen, P.A.

(57) ABSTRACT

A shelf structure includes a first and second panel. Each panel has a pair of transversely spaced apart side rails. A plurality of equidistantly spaced slots is formed in an inboard side of each of the side rails and a plurality of slats has opposed ends received within corresponding slots. The first and second panels are hingedly connected to one another at respective uppermost ends so that an "A" shape is formed when their respective lower ends are laterally spaced apart from one another. Each slat forming a part of the first panel has a transversely disposed, corresponding slat in the second panel at the same height so that removal of a pair of corresponding slats creates a pair of level openings. A shelf is slidingly inserted into each pair of openings. A chain interconnects the first panel and second panel near their lower ends to maintain the A shape.

4 Claims, 6 Drawing Sheets

A-FRAME SHELVING

BACKGROUND OF THE INVENTION

1. Field of the Invention

This invention relates, generally, to shelving. More particularly, it relates to an A-frame shelf structure that requires no tools to assemble.

2. Description of the Prior Art

Many people dislike making shelves because they have to purchase brackets, screws, and use various tools such as drills and screwdrivers to build and install the shelves. If the shelf is not built with a high level of skill, the resulting structure may be unstable, weak, and unsightly.

There is a need, therefore, for a shelf construction that does not require a user to buy brackets, screws, and the like, and which does not require the use of any tools.

There is also a need for a shelf that is stable and capable of supporting up to two hundred pounds of items.

A need exists as well for a shelf structure that is aesthetically pleasing as well.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a shelf that can be built without tools, that is strong, stable, and of attractive appearance is now met by a new, useful, and nonobvious invention.

The novel shelf structure includes a first panel having a pair of transversely spaced apart side rails and a plurality of transversely interconnecting walls for joining the side rails to one another at their respective top and bottom ends and at least one point therebetween.

A plurality of slots is formed in an inboard side of each of the side rails along substantially the entire extent of the side rails. Each slot of the plurality of slots that is formed in an inboard side of a first side rail of a panel is transversely opposed to a corresponding slot formed in an inboard side of a second side rail of the panel.

A second panel also has a pair of transversely spaced apart side rails and a plurality of transversely interconnecting walls for joining the side rails of the second panel to one another at their respective top and bottom ends and at least one point therebetween. A plurality of slots is formed in an inboard side of each of the side rails of the second panel along substantially the entire extent of the side rails.

Each slot of the plurality of slots that is formed in an inboard side of a first side rail of the second panel is transversely opposed to a corresponding slot formed in an inboard side of a second side rail of the second panel.

The first and second panels are hingedly connected to one another at respective uppermost ends so that an "A" shape is formed when their respective lower ends are laterally spaced apart from one another.

The first and second panels each include a large plurality of removable slats. Each slat has opposite ends received in transversely opposed pairs of slots.

Each slat that forms a part of the first panel has a transversely disposed, corresponding slat in the second panel at the same height so that removal of a pair of corresponding slats creates a pair of level openings and a shelf is slidingly inserted into the pair of level openings.

A flexible but non-stretchable chain means is disposed in interconnecting relation between the first panel and the second panel near respective lower ends thereof. The chain means has a first end secured to an edge of a side rail of a first panel at a preselected height. A catch (i.e. fastener shown but not labeled in FIGS. 5 and 6) is secured to an edge of a side rail of the second panel at said preselected height. The chain means has a latch secured to a free end thereof for releasably engaging the catch.

The primary object of this invention is to provide a shelving assembly that is assembled without brackets and which requires no tools.

Another important object is to provide a shelving assembly that is stable, strong, and aesthetically pleasing.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
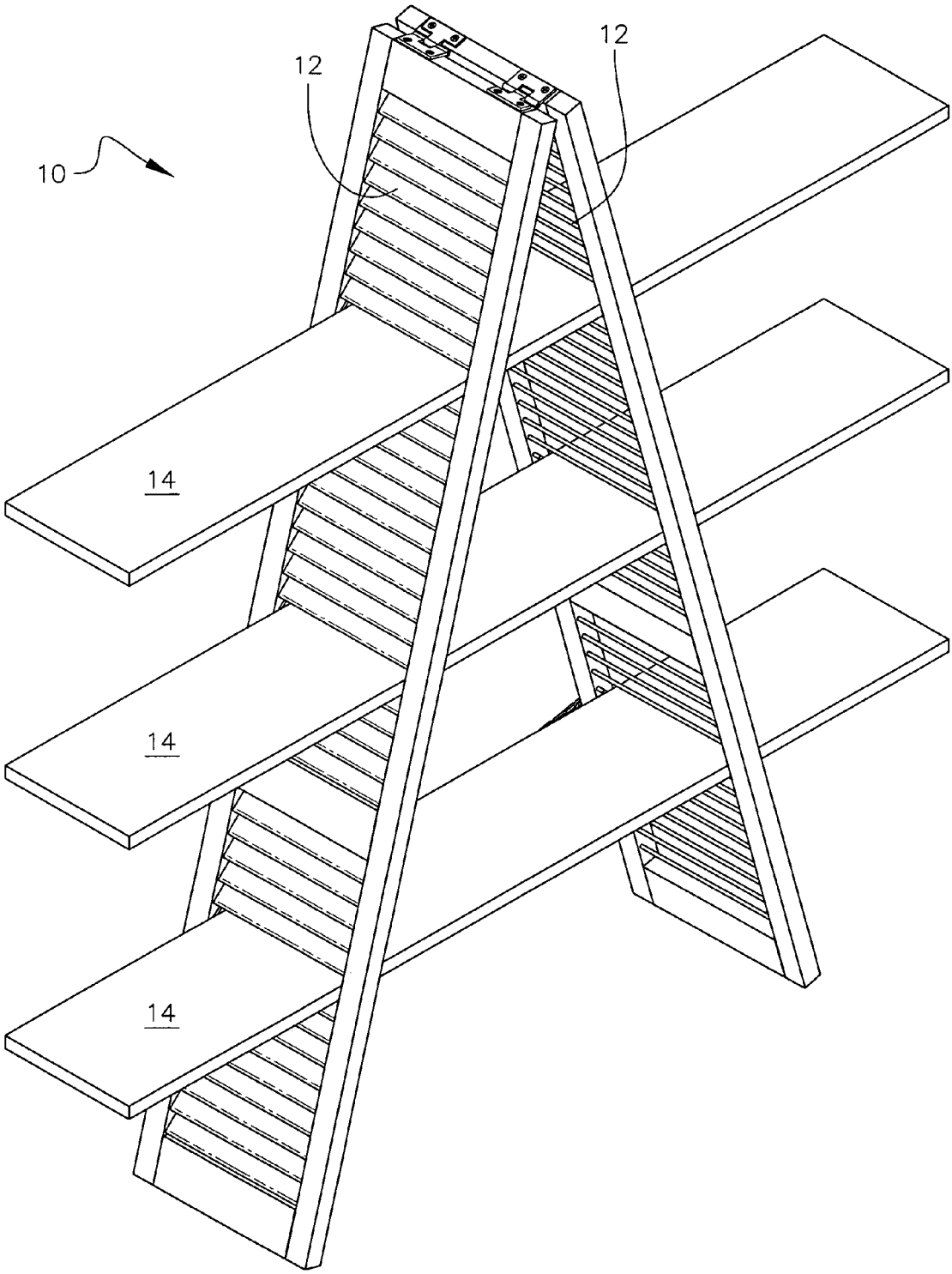
FIG. 1 is a perspective view of a first embodiment of the novel shelving.

Referring now to FIG. 1, it will there be seen that the reference numeral 10 denotes a first illustrative embodiment of the novel shelving.

A-frame shelving 10 includes two (2) generally upstanding panels 12, 12 that are identical in structure and hingedly connected to one another at their respective upper ends so that an "A" shape is formed when their respective lower ends are laterally spaced apart from one another as depicted in FIG. 1.

In the embodiment of FIG. 1, three (3) horizontal shelves, collectively denoted 14, are provided. The number of said horizontal shelves may be increased or decreased, depending primarily upon the height of the objects supported by said horizontal shelves.

Figure 2:
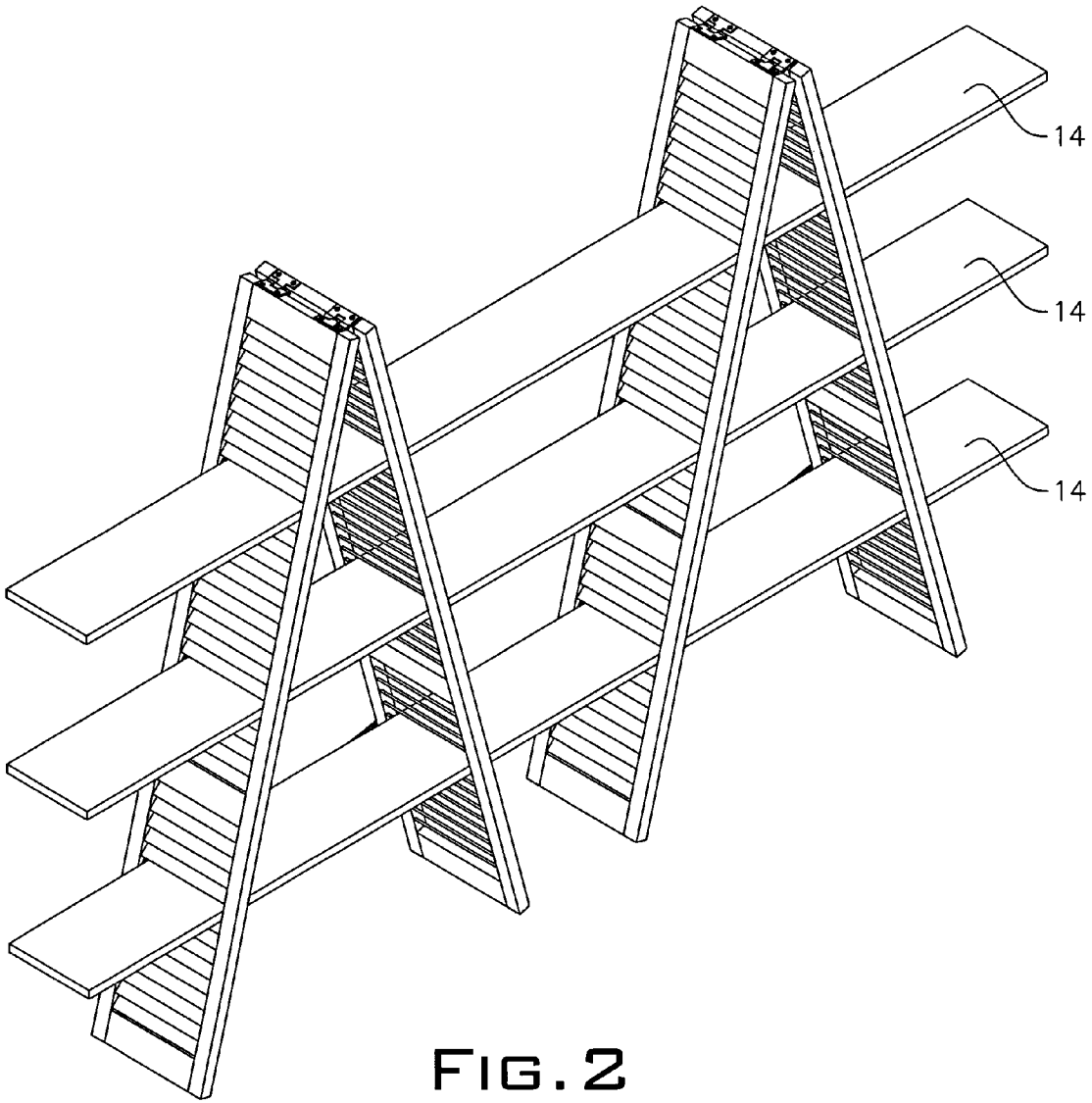
FIG. 2 is a perspective view of a second embodiment of the novel shelving.

Two pairs of panels may be interlocked to one another as depicted in FIG. 2. Shelves of increased length are required for this embodiment vis a vis the embodiment of FIG. 1.

Figure 3:
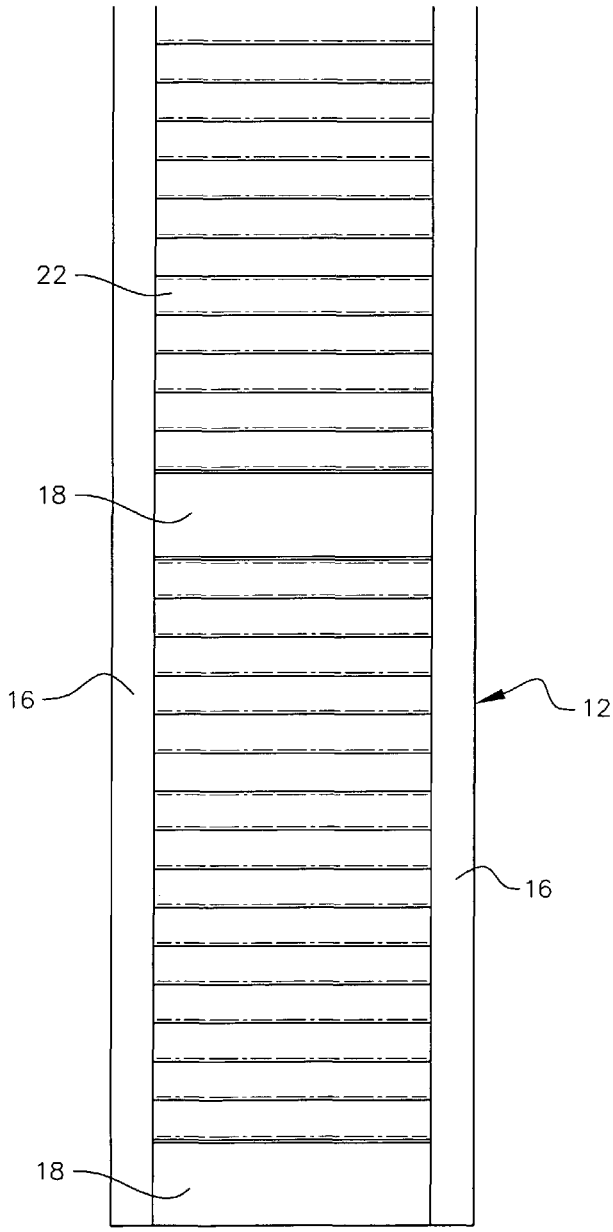
FIG. 3 is a front elevational view of a louvered panel having two louvers or slats removed.

As depicted in FIG. 3, each panel 12 includes a pair of laterally spaced apart side rails 16, 16 that are interconnected to one another at their respective tops and bottoms and at various mid-points by transverse walls, collectively denoted 18.

Figure 4:
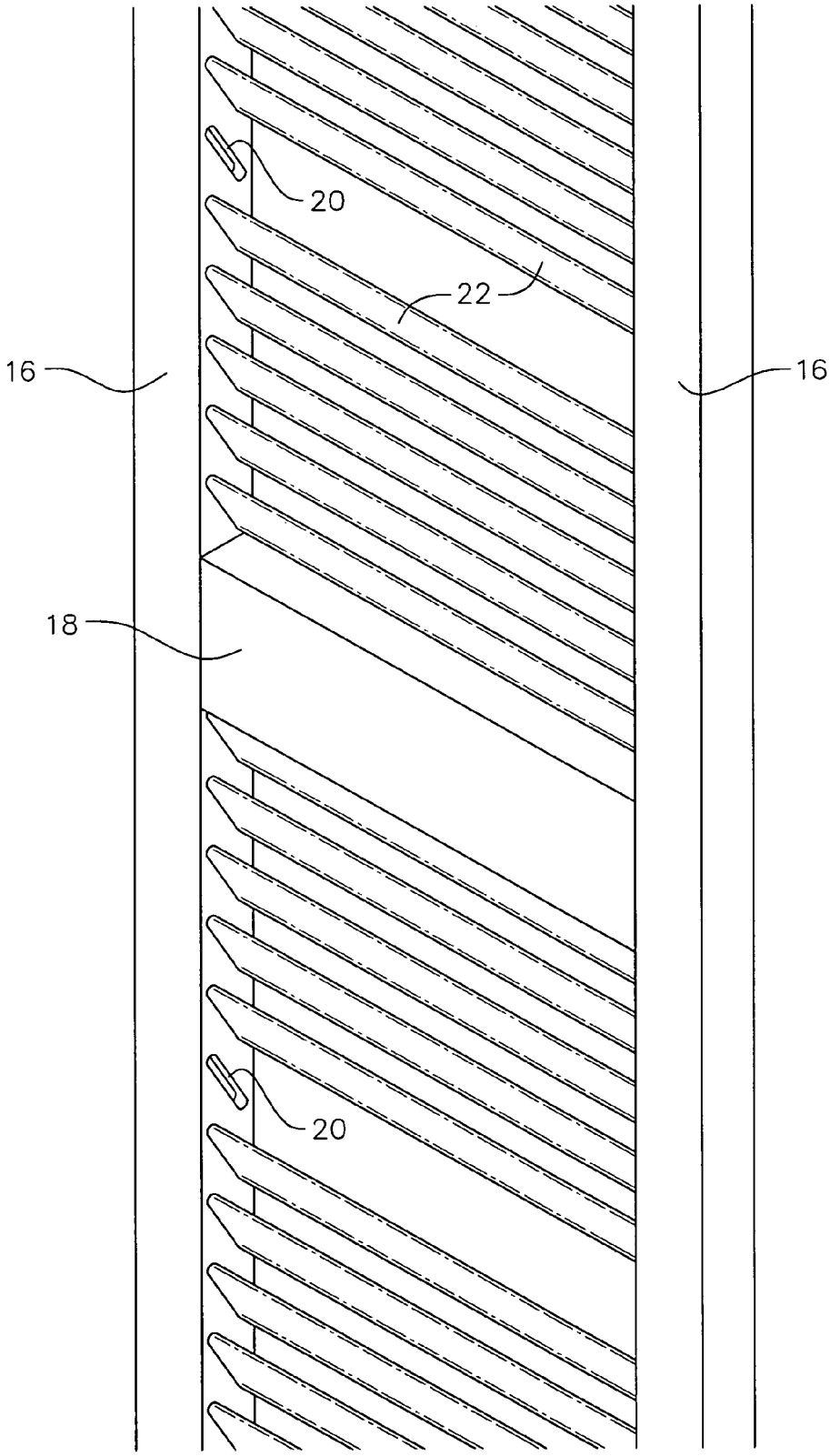
FIG. 4 is a detailed perspective view depicting a slot that receives one end of a louver.

As depicted in FIG. 4, a plurality of slots 20 is formed in an inboard edge of each side rail 16 along its extent and each slot is transversely spaced apart from a corresponding slot formed in the inboard side of its opposing side rail 16.

Each panel 12 includes a large plurality of removable slats or louvers, collectively denote 22, the respective opposite ends of each are received in said transversely opposed pairs of slots.

Each slat 22 that forms a part of a first panel 12 has a transversely disposed, corresponding slat in second panel 12 at the same height. Accordingly, removal of a pair of corresponding-in-height slats from two panels creates a pair of level openings through which is slidingly inserted a shelf 14.

In the example of FIG. 1, three pairs of slats 22 are removed to enable sliding insertion of three shelves, each of which is denoted 14 because they are of identical construction. However, shelves 14, 14, 14 could be provided in differing lengths and such shelving is clearly within the scope of this invention. Shelves 14 are preferably centered relative to a vertical axis of symmetry of the A-frame for stability.

A slat 22 is removed by grasping its middle and pulling on it. It has sufficient resiliency to bend until its opposed ends slide from their associated slots 20. If a user decides that a shelf 14 is at an undesirable height, the shelf is slid out and the slat is replaced by inserting one end in a slot and bending the middle of the slat so that the opposite end can return to its original position. Another pair of slats at a more desirable height is then removed and the shelf is reinstalled at the more desirable height.

Figure 5:
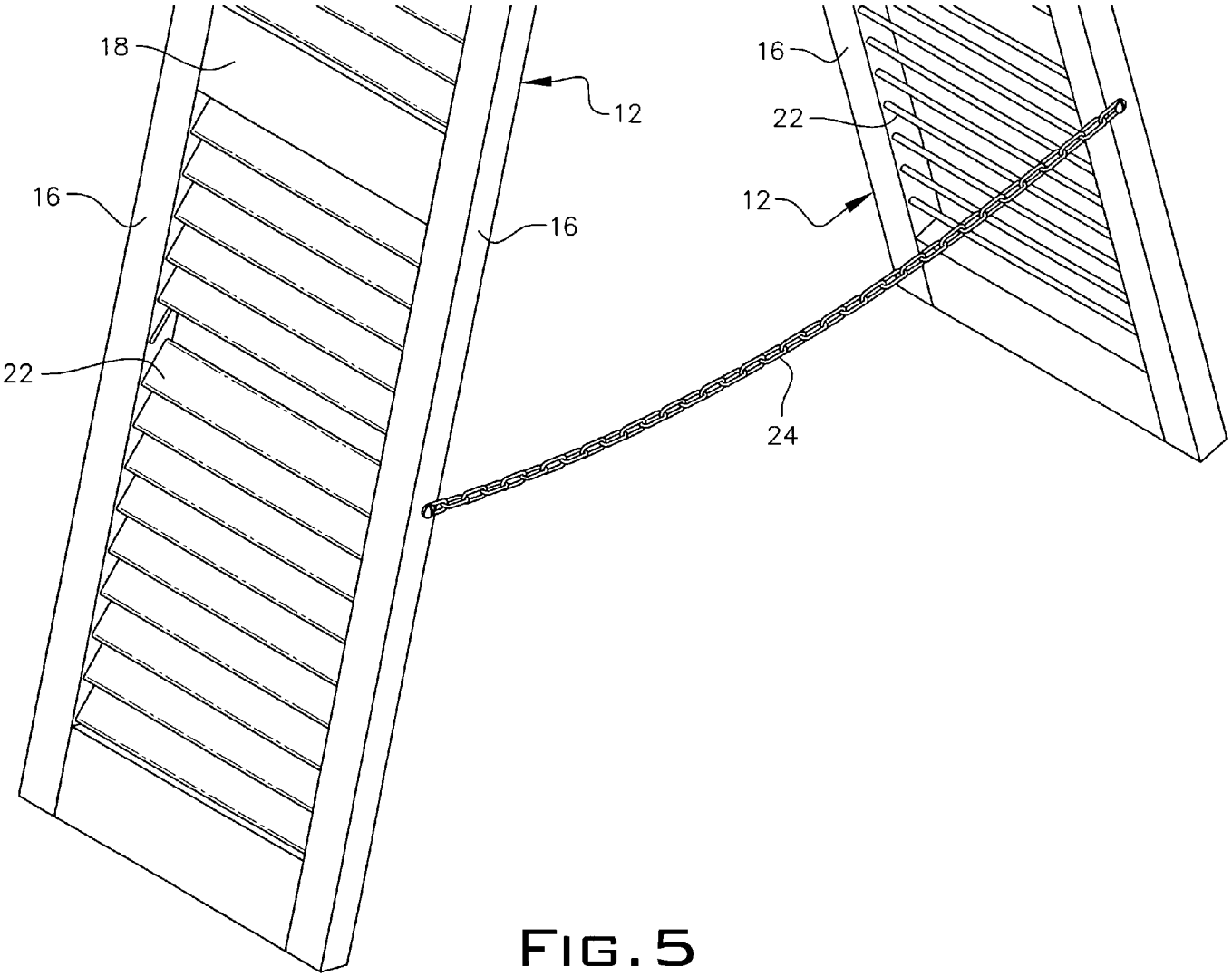
FIG. 5 is a perspective view depicting two louvered panels disposed in an "A" configuration and a chain that interlinks them to one another.

A chain means 24 or similar non-elastic member such as a cable, rope, string or the like is depicted in FIG. 5. It is used to prevent the respective bottoms of panels 12, 12 from sliding too far apart from one another. A first end of the chain is secured by any suitable means to an edge of a side rail 16 of a first panel 12 at a preselected height and a catch (i.e. fastener shown but not labeled in FIGS. 5 and 6) is secured to an edge of a side rail 16 of a second panel 12 at the preselected height. The free end of chain 24 has a latch for releasably engaging the catch. The distance between the respective bottoms of panels 12, 12 is determined by the length of the chain and said length is adjustable by any suitable means. The latch releasably engages the catch so that the latch and catch may be unhooked from one another when it is desired to collapse the A-frame so that both panels 12, 12 abut one another along their respective lengths as when the shelving is placed into a storage configuration during a move, for example.

Figure 6:
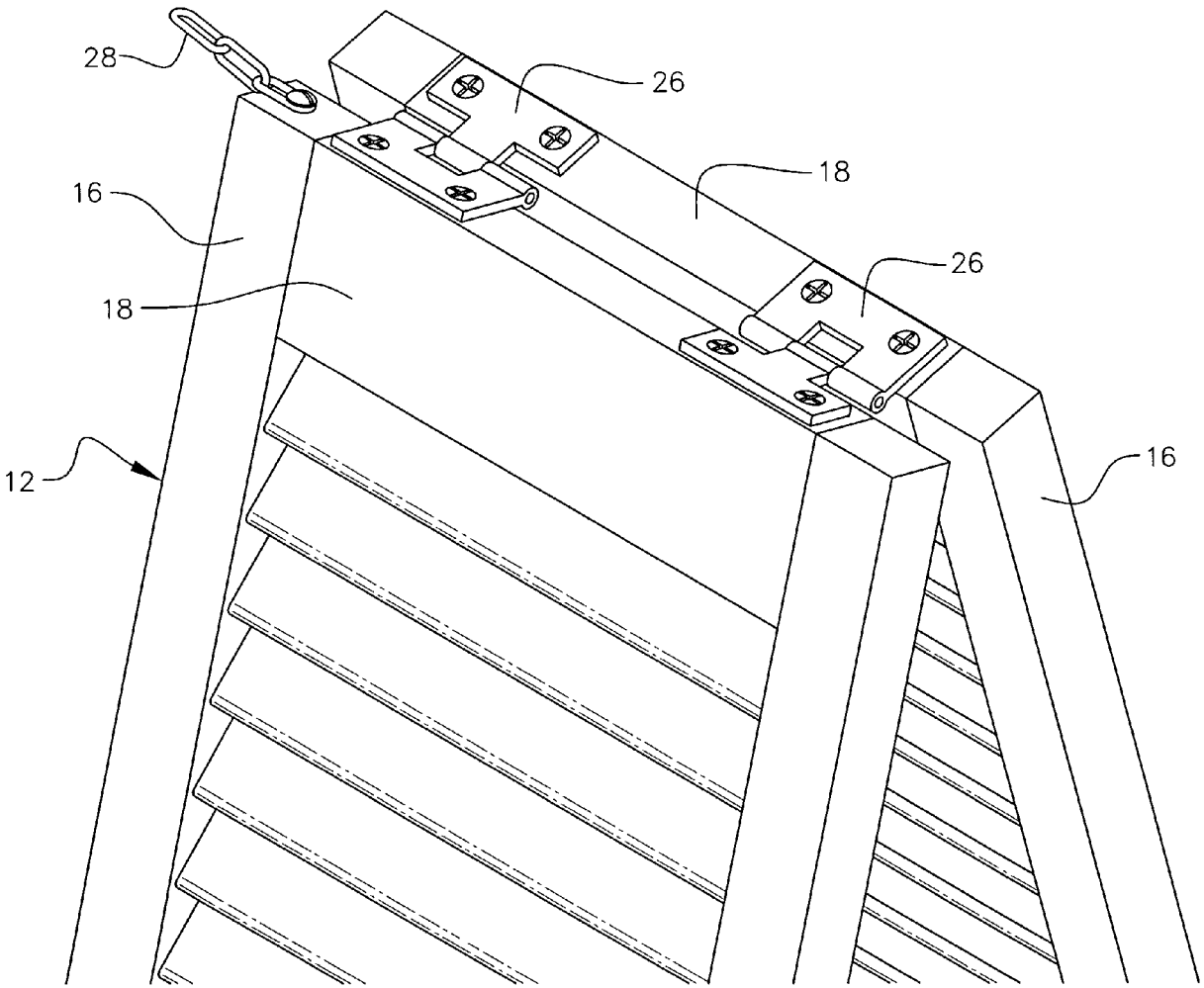
FIG. 6 is a top plan view depicting two panels and the hinges that interconnect them to one another at their respective top ends, and an optional safety chain that screws into the A-Frame and a nearby wall.

The hinges that interconnect panels 12, 12 at their respective uppermost ends are denoted 26, 26 in FIG. 6.

An optional chain means 28 or similar non-elastic member such as a cable, rope, string or the like is depicted in FIG. 6. It is used to prevent the frame from tipping over easily especially when children are present. It does not replace parental control. A first end of the chain is secured by any suitable means to an edge of the top of transverse wall 18 and the other end with a screw and anchor into a wall, not shown, next to the A-frame.

Due to the see-through design of the novel shelving, the unit (FIG. 1) or multiple units (FIG. 2) may be placed in front of windows without substantially blocking the view, depending upon the number and placement of objects on the shelves.

The unit is light-in-weight so that it can be assembled in one location and moved to another when the assembly is finished. It is preferably made of solid wood and can hold up to two hundred pounds. Significantly, no tools whatsoever are required in the assembly or disassembly of the novel shelves.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A shelf structure, comprising:

a first panel having a pair of transversely spaced apart side rails;

a plurality of equidistantly spaced apart slots formed in an inboard side of each of said side rails along substantially the entire extent of said side rails;

each slot of said plurality of slots formed in an inboard side of a first side rail of a panel being transversely opposed to a corresponding slot formed in an inboard side of a second side rail of said panel;

a second panel having a pair of transversely spaced apart side rails;

a plurality of equidistantly spaced apart slots formed in an inboard side of each of said side rails of said second panel along substantially the entire extent of said side rails;

each slot of said plurality of slots formed in an inboard side of a first side rail of said second panel being transversely opposed to a corresponding slot formed in an inboard side of a second side rail of said second panel;

said first and second panels being hingedly connected to one another at respective uppermost ends so that an "A" shape is formed when respective lower ends of said first and second panels are laterally spaced apart from one another;

said first and second panels each including a large plurality of removable slats;

each slat having opposite ends received in transversely opposed pairs of said slots;

each slat that forms a part of said first panel having a transversely disposed, corresponding slat in said second panel;

at least one pair of transversely opposed slots formed in said first panel at a predetermined height having no slat received therewithin;

a first opening formed in said first panel by said at least one pair of transversely opposed slots formed in said first panel having no slat received therewithin;

at least one pair of transversely opposed slots formed in said second panel at said predetermined height having no slat received therewithin;

a second opening formed in said second panel by said at least one pair of transversely spaced apart slots formed in said second panel having no slat received therewithin;

a shelf being slidingly inserted into said first and second openings;

said slats of said large plurality of slats being spaced closely together so that no shelf may be extended between said first and second panels when all of said slats are installed in said shelf structure; and each of said slats being manually removable from its associated slots.

2. The shelf structure of claim 1, further comprising:

a flexible but non-stretchable chain means disposed in an interconnecting relation between said first panel and said second panel;

said chain having a first end secured to an edge of a preselected side rail of said first panel at a preselected height;

a catch secured to an edge of a preselected side rail of the second panel at said preselected height;

said chain having a latch secured to a free end thereof for releasably engaging the catch.

3. The shelf structure of claim 1, further comprising:

said side rails of said first panel joined to one another by a plurality of transversely disposed interconnecting walls at respective top and bottom ends and at least one point therebetween.

4. The shelf structure of claim 1, further comprising:

said side rails of said second panel joined to one another by a plurality of transversely disposed interconnecting walls at respective top and bottom ends and at least one point therebetween.

* * * * *